United States Patent [19]

Hibino et al.

[11] 4,182,209

[45] Jan. 8, 1980

[54] WAVEFORM GENERATOR

[75] Inventors: Masahiro Hibino; Kenji Shima, both of Amagasaki, Japan

[73] Assignee: Mitsubishi Denki Kabushiki Kaisha, Tokyo, Japan

[21] Appl. No.: 755,579

[22] Filed: Dec. 29, 1976

[30] Foreign Application Priority Data

Dec. 29, 1975 [JP] Japan ..... 50-157827
Jan. 22, 1976 [JP] Japan ..... 51-6066

[51] Int. Cl.[2] ..... G10H 1/02; G10H 3/06
[52] U.S. Cl. ..... 84/1.01; 84/1.18; 84/1.25; 84/DIG. 19; 338/90
[58] Field of Search ..... 84/1.01, 1.18, 1.24, 84/1.25, DIG. 19, 1.27, DIG. 7; 338/90, 95, 126, 140, 185, 190; 364/718, 721

[56] References Cited

U.S. PATENT DOCUMENTS

| | | | |
|---|---|---|---|
| 3,178,566 | 4/1965 | Harpell | 338/90 X |
| 3,564,104 | 2/1971 | Reynolds | 84/1.01 |
| 3,626,350 | 12/1971 | Suzuki et al. | 84/DIG. 7 |
| 3,733,955 | 5/1973 | Reinagel et al. | 84/1.01 |
| 3,821,714 | 6/1974 | Tomisawa et al. | 84/1.01 X |
| 3,919,911 | 11/1975 | Nakata et al. | 84/DIG. 19 |

*Primary Examiner*—Stanley J. Witkowski
*Attorney, Agent, or Firm*—Oblon, Fisher, Spivak, McClelland & Maier

[57] ABSTRACT

A waveform generator used for electronic musical instruments comprising a resistance device having a plurality of power source electrodes and a plurality of potential detecting electrodes. Electric current is supplied to the power source electrodes and potentials are periodically detected through scanning from the potential detecting electrodes by the use of a scanning circuit mechanism.

11 Claims, 41 Drawing Figures

FIG. 13
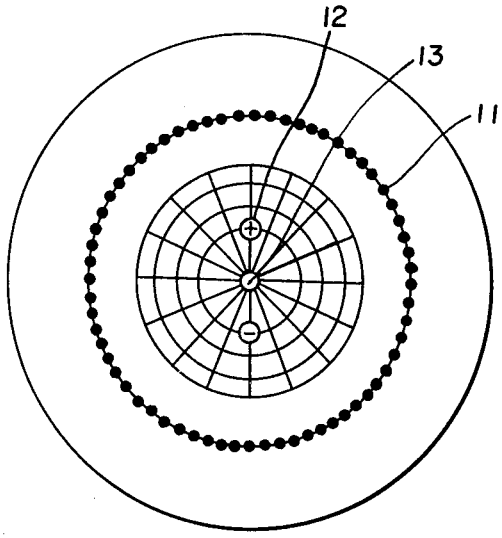
FIG. 14A
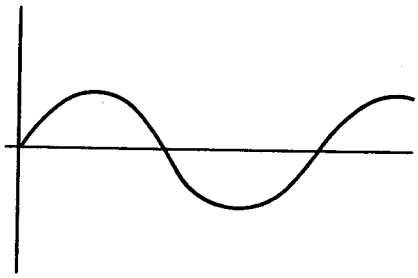
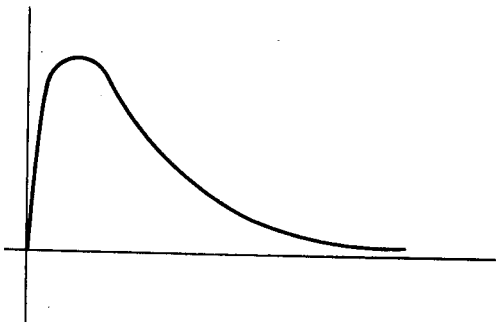
FIG. 14B

FIG. 15
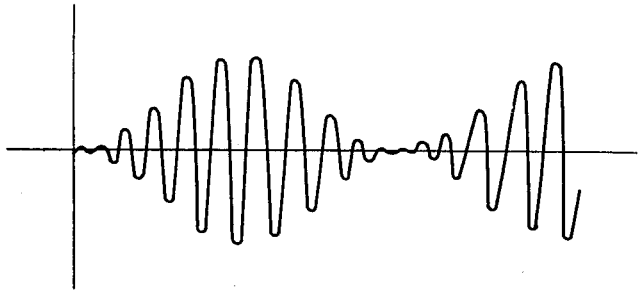
FIG. 16A
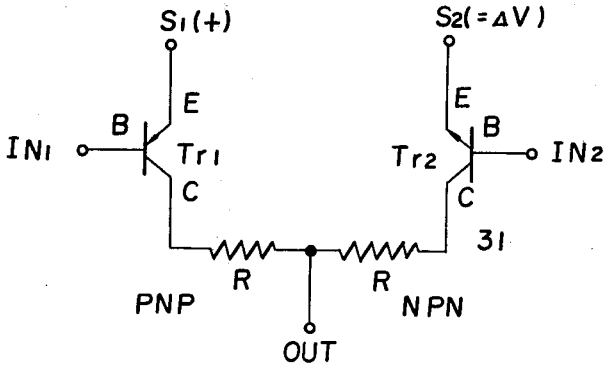
| IN1 | IN2 | OUT |
|---|---|---|
| L | L | S1 |
| L | H | $\frac{S_1+S_2}{2}$ |
| H | L | High Impedance |
| H | H | S2 |
FIG. 16B

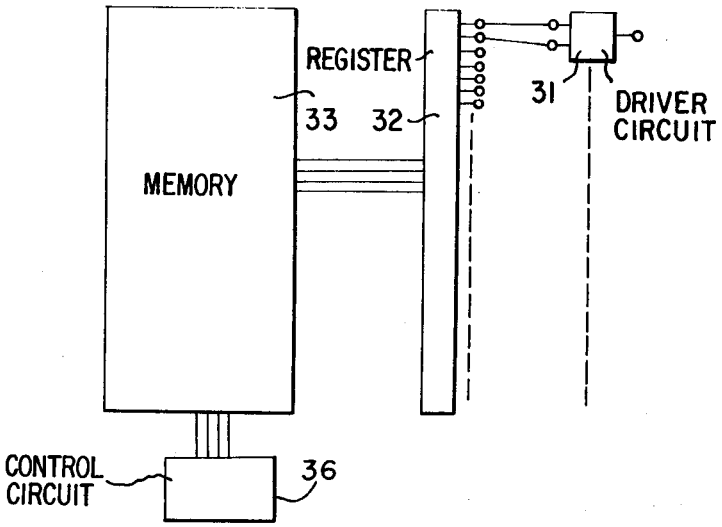
FIG. 18
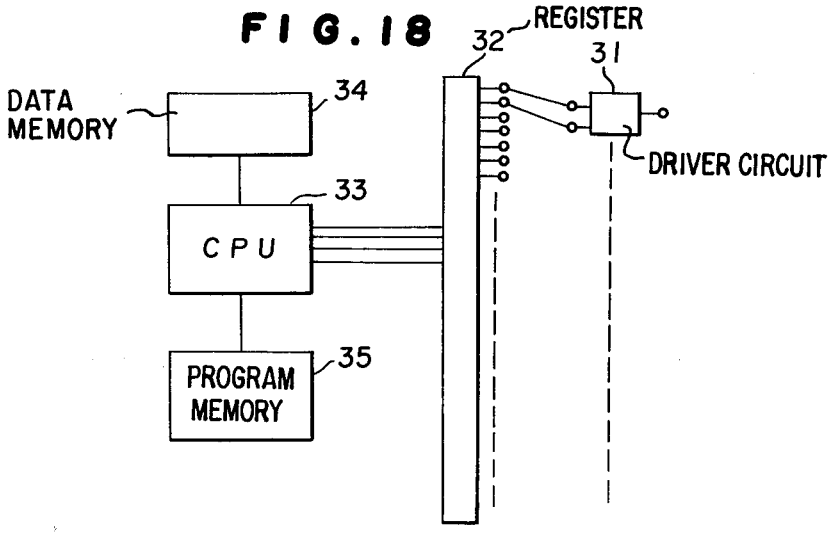
FIG. 19
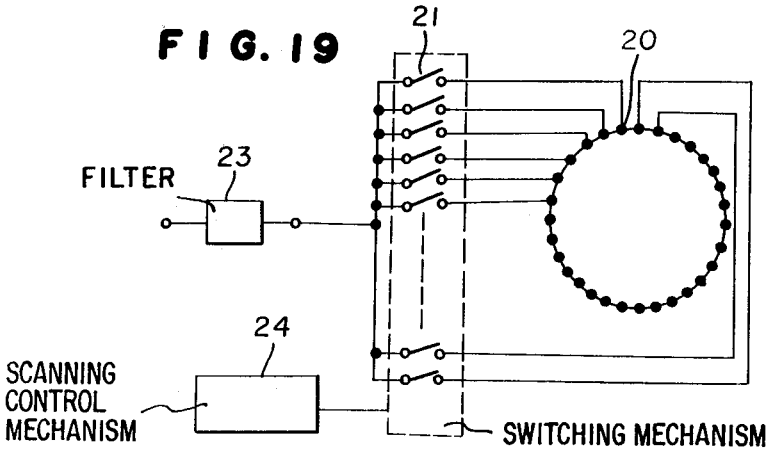

| A | B | C | ONChanne |
|---|---|---|---|
| 0 | 0 | 0 | 1 |
| 0 | 0 | 1 | 2 |
| 0 | 1 | 0 | 3 |
| 0 | 1 | 1 | 4 |
| 1 | 0 | 0 | 5 |
| 1 | 0 | 1 | 6 |
| 1 | 1 | 0 | 7 |
| 1 | 1 | 1 | 8 |

FIG. 23
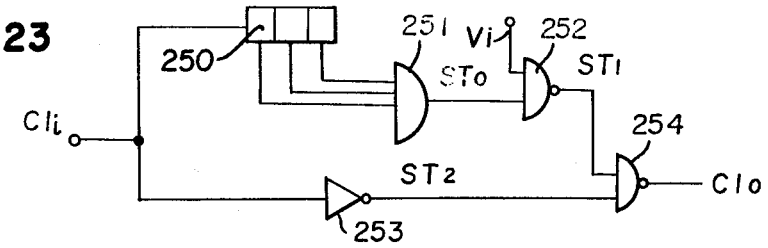
FIG. 24
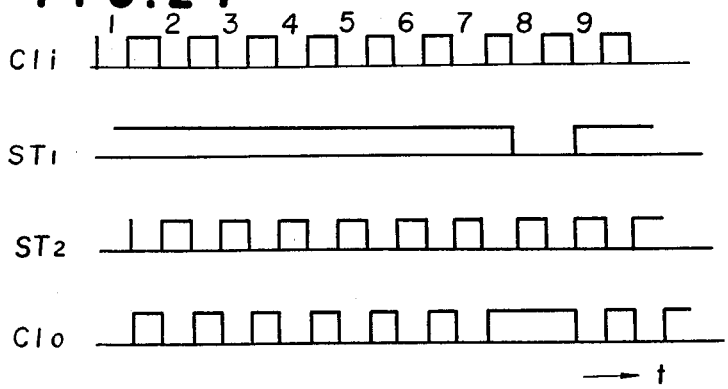
FIG. 25
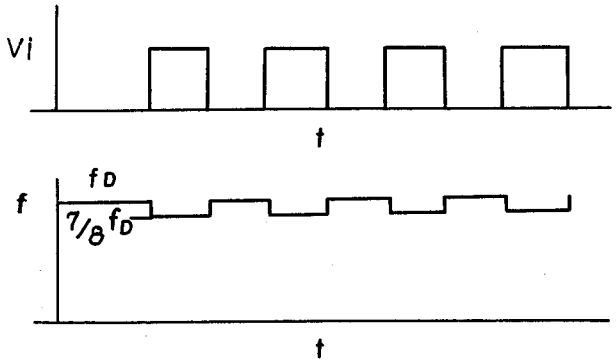
FIG. 26
| | | | | | | | | |
|---|---|---|---|---|---|---|---|---|
| V1 = H | | | | 64 | | | | 128 |
| V2 = H | | | 32 | | 64 | | 96 | 128 |
| V3 = H | 16 | 32 | 48 | 64 | 80 | 96 | 112 | 128 |

FIG. 27
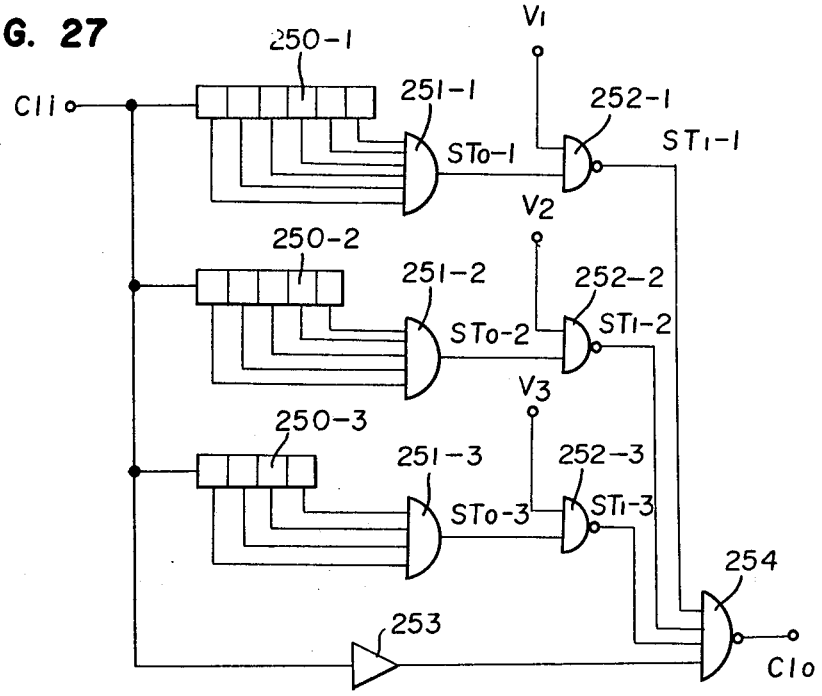
FIG. 28A
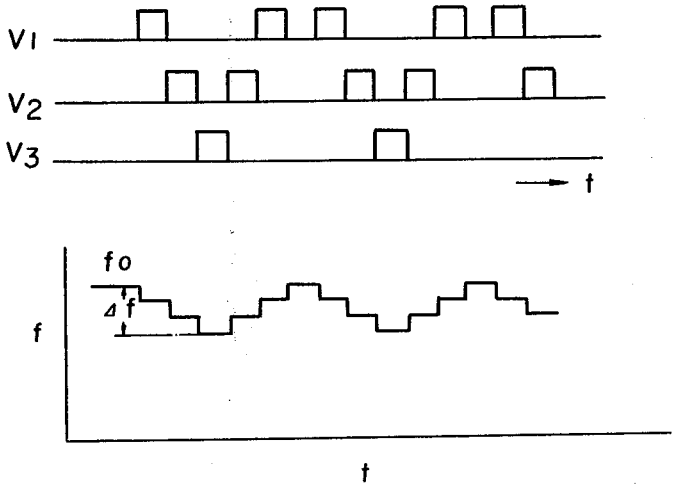
FIG. 28B

WAVEFORM GENERATOR

BACKGROUND OF THE INVENTION

The present invention relates to devices capable of generating a wide range of musical-sound waveforms useful in creating or simulating the musical sound of a musical instrument.

Various approaches have been known in the art of generating musical-sound waveforms; they may be classified broadly under (A) analog method and (B) digital method as follows:

(A) Analog Method (i) Method for synthesizing sine waves generated at various frequencies.

(ii) Method for producing changes in frequency spectrum from pulses or square waves through filters.

(iii) Method for electrically detecting mechanical vibrations of various waveforms.

(B) Digital Method

Instantaneous values of a waveform are digitized and converted into a musical-sound waveform by a D/A converter.

In both analog and digital methods, a large number of control signals are required to obtain substantial variations in the musical-sound wave, resulting in the need for intricate mechanisms. Conversely, with a simple control mechanism, the variety of waveforms available is limited.

According to the method (A)-(i), higher order harmonics, in addition to a fundamental sine wave, must be provided in order to obtain a variety of waveforms. Furthermore, means must be used to control the individual harmonics by controlling the gain of an amplifier or through a resistance voltage-divider in order to control the musical-sound waveform. According to the method (A)-(ii), the kind of waveforms available is limited. The method (A)-(iii) requires the use of various mechanical vibration systems to produce necessary waveforms.

According to the method (B), a computer system having a large memory must be used.

In any prior art method, the mechanism for generating waveforms and means for controlling them are too intricate in construction to vary each waveform instantly and frequently in performing with an electronic musical instrument.

SUMMARY OF THE INVENTION

It is therefore an object of the present invention to provide a waveform generator operable free of the prior art drawbacks.

The waveform generator of the invention comprises (1) a resistance plate having suitable electrical resistance, (2) a plurality of power source electrodes and a plurality of potential detecting electrodes disposed on the resistance plate, (3) a power source unit for supplying a suitable electrode potential pattern to the power source electrodes, and (4) a scanning circuit mechanism for scanning in sequence the potentials at the potential detecting electrodes and converting the voltage distribution on the resistance plate into a cyclic voltage waveform.

According to the invention, the time taken for the scanning circuit mechanism to scan potentials at all the potential detecting electrodes is determined to be equal to the fundamental period of a cyclic waveform generated. Thus a cyclic waveform generated can include only the harmonics of integer orders and hence is desirable for use as musical sound waveforms.

Furthermore, the waveform generated according to the invention is highly useful in creating musical sound available with such musical instruments as keyed instruments, wind instruments and string instruments. In these 'natural' instruments, the sound waveform varies with time; in a wind instrument such as flute, the sound produced in the beginning of play has a waveform containing many higher order harmonics, and these harmonics gradually attenuate or vanish, resulting in a smooth waveform having harmonics of third or fourth order at the highest. To simulate this musical sound, the waveform must be varied with time. The waveform generator of the invention can generate waveforms which simulate such musical sound with ease.

Further objects, features and advantages of the invention will become more apparent from the following description when read in conjunction with the accompanying drawings, in which:

BRIEF DESCRIPTION OF THE DRAWING

FIG. 13 is a schematic diagram showing another resistance plate used in a waveform generator according to the invention, FIGS. 14A, 14B and 15 are graphic diagrams for illustrating operations of the embodiment shown in FIG. 13, FIG. 16A schematically illustrates a power source circuit used in a waveform generator of the invention, FIG. 16B is a function table, FIG. 17 is a diagram showing a power source electrode pattern varying system used in a waveform generator of the invention, FIG. 18 is a diagram showing another power source electrode pattern varying system used in a waveform generator of the invention, FIG. 19 is a diagram showing fundamental circuits and functions of a scanning circuit mechanism used in a waveform generator of the invention, FIG. 23 is a circuit diagram showing a fundamental circuit used for frequency modulation in a waveform generator of the invention, FIGS. 24 and 25 are diagrams showing signal states and frequencies for illustrating circuit functions shown in FIG. 23, FIG. 26 is a table for illustrating means for generating musical sound with a vibrato effect by the use of the fundamental circuit shown in FIG. 23, FIG. 27 is a circuit diagram showing a circuit construction capable of producing a vibrato effect according to circuit functions shown in FIG. 26, FIGS. 28A and 28B are graphic diagrams showing a relationship between the modulated input signal and variations in the frequency of the signal waveform in relation to the operation of the circuit shown in FIG. 27, FIGS. 29A, 29B and 29C are diagrams showing output waveforms of the waveform generator shown in FIG. 1, FIGS. 30A and 30B are diagrams useful for illustrating operations of a waveform generator of the invention.

DESCRIPTION OF THE PREFERRED EMBODIMENTS

Figure 1:
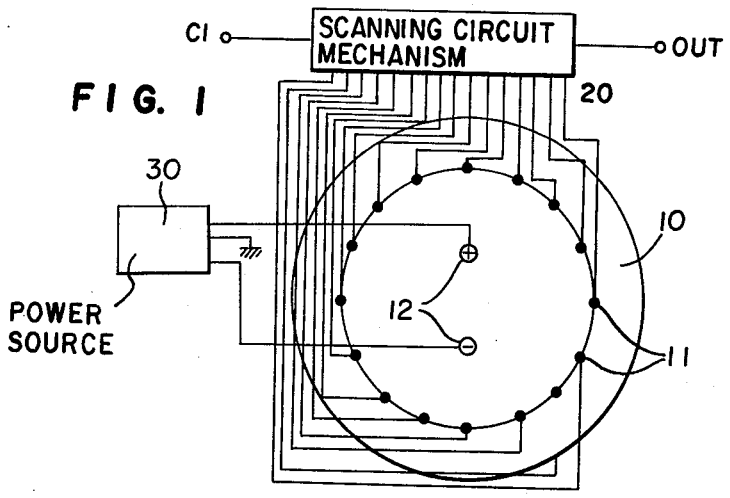
FIG. 1 is a diagram showing the construction of a waveform generator of the invention.
Figure 2:
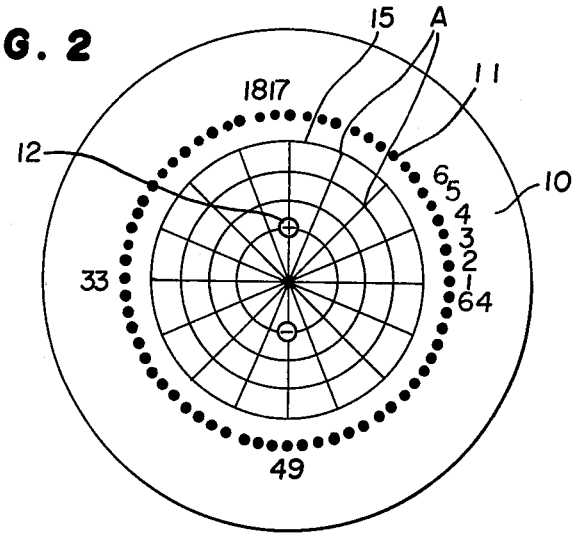
FIGS. 2 to 4 are schematic diagrams showing resistance plates used in a waveform generator according to the invntion.
Figure 3:
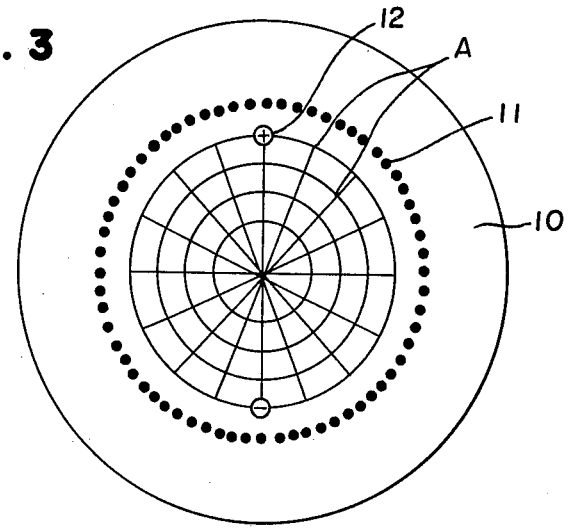
Figure 4:
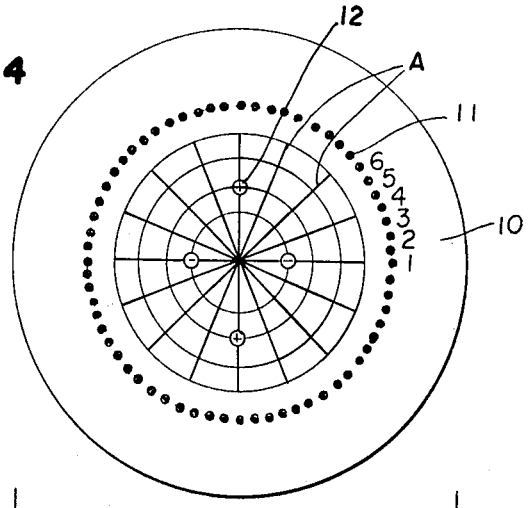

With reference now to FIG. 1, there is schematically shown one embodiment of the invention, which comprises a resistance plate 10 used as an important element for the purpose of the invention. The resistance plate has a plurality of potential detecting electrodes 11 and a plurality of current supplying power source electrodes 12. A scanning circuit mechanism 20 is provided for deriving in sequence potentials from the potential detecting electrodes 11. The scanning circuit mechanism 20 is driven by a clock pulse Cl of suitable frequency and generates a scanned potential at a terminal OUT. There is a power source unit 30 for supplying current or voltage to the power source electrodes 12. The resistance plate 10 is made of a material with the property of electrical resistance such as, for example, an electrically conductive paper (or resistance paper), silicon plate, or plate formed of sintered metal powder. The electrodes 11 and 12 are metal pins implanted on the resistance plate 10 or metal strips bonded onto the resistance plate 10 or formed in such manner that a metal is coated on one surface of the resistance plate and areas other than those to serve as the electrodes are removed by etching techniques and then lead wires are bonded to the individual metal portions. FIG. 2 shows the resistance plate 10 in greater detail. In this embodiment, the resistance plate 10 is disk-shaped, having 64 potential detecting electrodes 11 disposed at regular intervals and concentrically with the resistance plate or disk 10. The power source electrodes 12 are on a diametral line on the disk, forming a dipole. In this embodiment, the electrodes 12 are located relatively near the center of the disk 10. Other forms of resistance plate 10 are schematically shown in FIGS. 3 and 4. In FIG. 3, two power source electrodes 12 are located relatively away from the center and near the potential detecting electrode 11. In FIG. 4, two positive electrodes 12 and two negative electrodes 12 are located symmetrically with respect to the center thereof.

Figure 5:
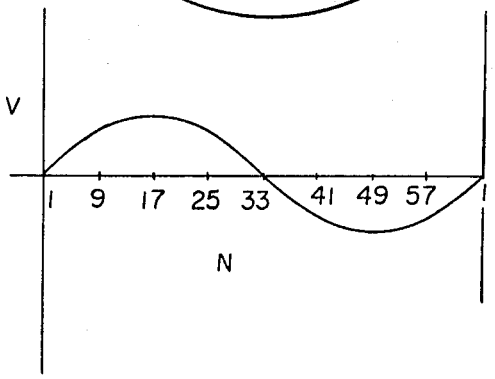
FIGS. 5 to 7 are waveform diagrams showing voltage distributions on potential detecting electrodes for operations in relation to operations shown in FIGS. 2 to 4.
Figure 6:
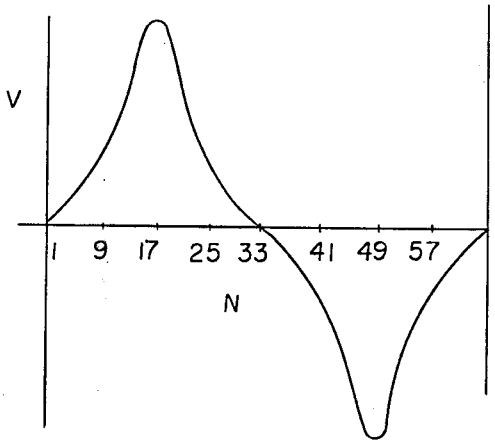
Figure 7:
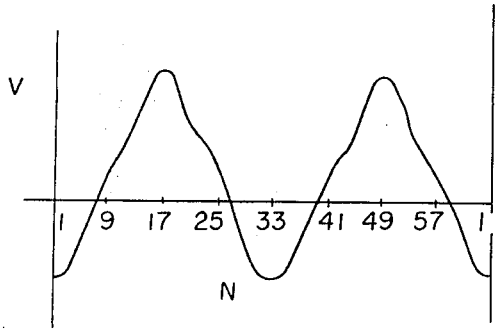

On the resistance plate 10, an electric field is formed by the current supplied to the power source electrodes 12 from the power source unit 30 and, at the same time, a potential distribution is formed thereon. The potential distribution along a form-generating closed curve (hereinafter referred to as potential detecting curve) of the 64 potential detecting electrodes 11 is as shown in FIG. 5 or in FIG. 6 or in FIG. 7 corresponding to the arrangement of electrodes 11 as shown in FIG. 2 or in FIG. 3 or in FIG. 4. In FIGS. 5 to 7, the numerals on the abscissa indicate in order the numbers assigned to the potential detecting electrodes 11 shown in FIGS. 2 to 4 respectively, and the ordinate stands for voltage. Because the potential detecting electrodes 11 are located at regular intervals, potentials derived from the individual electrodes differ one another; however, the resultant potential distribution assumes a smooth curve as shown in FIGS. 5 to 7 as long as the number of electrodes 11 is large enough. The potential distribution will be described in more detail.

In the arrangement of power source electrodes shown in FIG. 2 where two power source electrodes of the same magnitude and opposite polarity are located symmetrically with respect to the center and near the center of the resistance disk and form a dipole, the potential distribution along the potential detecting curve is as shown in FIG. 5. That is, the potential distribution assumes an approximately sine waveform, having a period of $2\pi$ for the potential to turn around the potential detecting curve. In the arrangement shown in FIG. 3 where two power source electrodes of the same magnitude and opposite polarity are located symmetrically with respect to the center of the resistance disk and near the potential detecting electrodes, the potential distribution along the potential detecting curve is as shown in FIG. 6. This distribution curve assumes a distorted waveform having a period of $2\pi$. In the arrangement shown in FIG. 4 where four power source electrodes, two each being the same in magnitude and opposite in pole, are located symmetrically with respect to the center thereof, the potential distribution along the potential detecting curve is as shown in FIG. 7. This distribution curve assumes a waveform having a period of $\pi$ for the potential to run half the potential detecting curve.

As apparent from the potential distribution curves shown in FIGS. 5 to 7, the waveform of the potential distribution along the potential detecting curve can be varied by varying the positions and the number of power source electrodes. Assume that the power source electrodes are installed at all the lattice intersections A of lattice pattern 15 as in FIGS. 2 to 4 and that (1) a positive current is supplied to the lattice intersections A (that is, current flows in the resistance plate from the power source), (2) a negative current is supplied to the lattice intersections (that is, current returns to the power source from the resistance plate), or (3) no current is supplied thereto. Then, by selecting one of the conditions (1) to (3), a desired power source electrode pattern can be obtained. In other words, when the number of lattice intersections is N, $3^N$ numbers of current fields can be produced to enable potential distributions to appear on the potential detecting curve in different waveforms corresponding to the individual current fields formed on the resistance plate.

The potential distribution appearing on the potential detecting curve is detected in terms of periodical voltage waveform changes by sequentially scanning the potentials at the potential detecting electrodes at regular time intervals by the use of a scanning circuit mechanism shown in FIG. 1. The detected output is available at the terminal OUT.

The power source electrode pattern can be expressed by 2N numbers of bits and hence $3^N$ numbers of voltage waveforms for one cycle can be stored in a digital memory whose capacity is as small as 2N bits. Thus, by changing the bit pattern of 2N bits, the voltage waveform can be instantly varied irrespective of speed at which the potentials at the potential detecting electrodes are scanned. This is feasible due to the principle of the invention that the voltage waveform is stored by the current field produced by the power source electrode pattern on the resistance plate.

Figure 8:
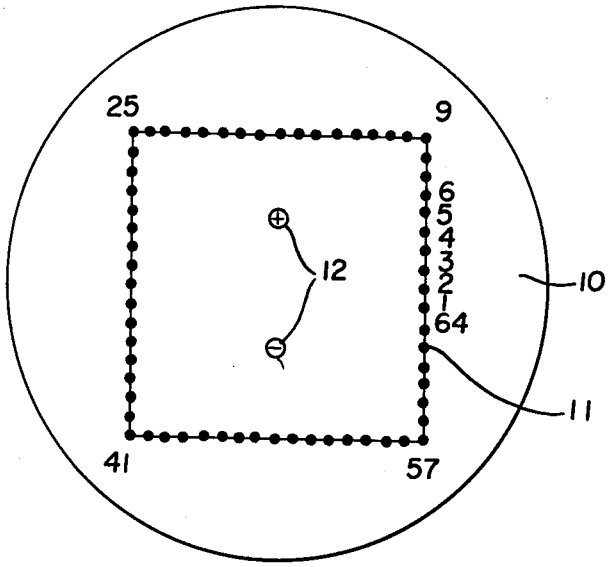
FIG. 8 is a schematic diagram showing another resistance plate used in a waveform generator according to the invention.
Figure 9:
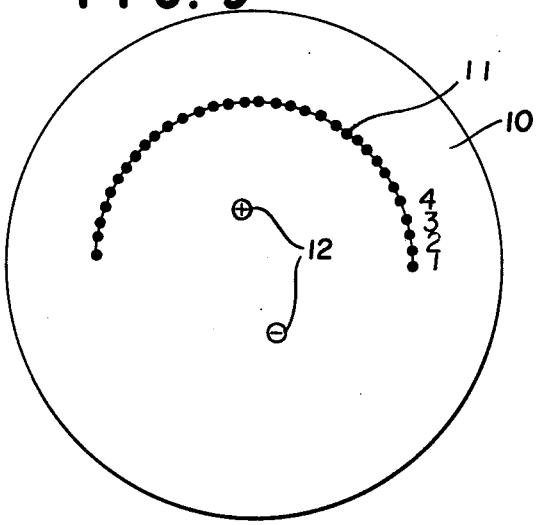
FIG. 9 is a schematic diagram showing another resistance plate of the invention.

Arrangements have been exemplified in the above embodiments in which the potential detecting electrodes are located concentrically with the resistance disk. The invention is not limited to the disclosed arrangements depending on the use of waveforms; the potential detecting electrodes may be disposed along arms of a rectangle as shown in FIG. 8 or on the circumference of a semicircle as shown in FIG. 9. Any arrangement of potential detecting electrodes on the resistance plate may be made to meet the purpose of waveforms. For example, when the electrodes are disposed along an open curve as in FIG. 9, the output waveform available includes steep voltage variations, depending on how the electrode potentials are scanned. Such waveform is suited for creating musical sound comprising higher order harmonics such as produced by a percussion instrument.

Figure 10:
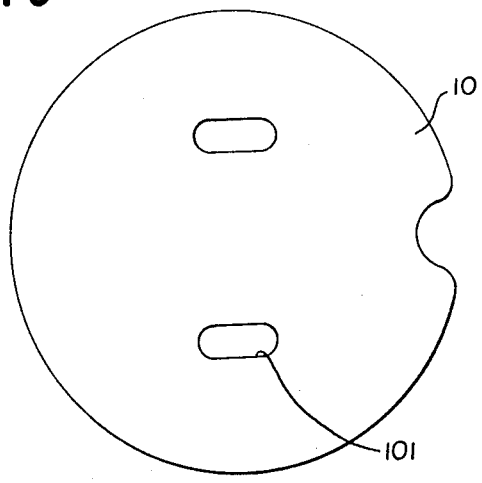
FIG. 10 is a schematic diagram showing another resistance plate of the invention.
Figure 11:
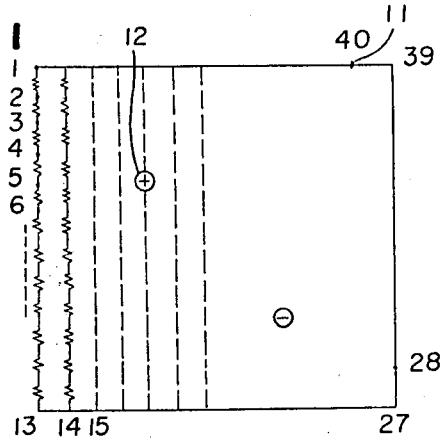
FIG. 11 is a schematic diagram showing a resistance network used in a waveform generator according to the invention.

Although disk-shaped resistance plates have been shown in the above embodiments, the invention is not limited to this shape; the resistance plate may be rectangular, polygonal, annular or have openings 101 or a cut in the periphery as shown in FIG. 10. Another resistance plate is schematically illustrated in FIG. 11 in which resistance elements are connected in rows and power source electrodes 12 and potential detecting electrodes 11 are installed at the junctions between resistance elements. In any arrangement of resistance plate, a current field is produced on the resistance plate by a pattern generated by a plurality of power source electrodes installed on the resistance plate, and a voltage waveform is produced by scanning potentials at a plurality of potential detecting electrodes installed on the resistance plate. The voltage waveform can be instantly varied by changing the electrode pattern.

Figure 12:
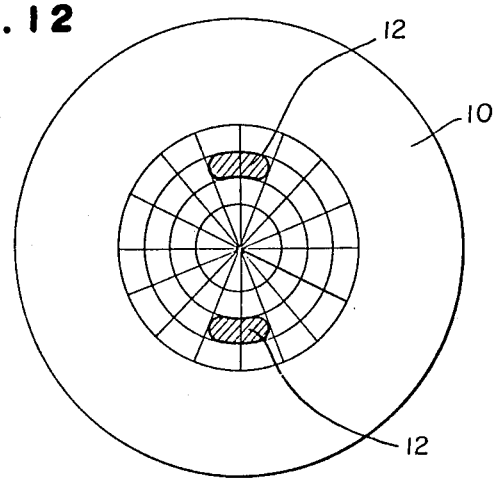
FIG. 12 is a schematic diagram showing another resistance plate of the invention.

According to the invention, the electrodes are not necessarily of the form of a point-electrode; especially, the power source electrodes may be in the form of a plane electrode depending on the user's purposes, an example of which is schematically shown in FIG. 12.

According to the invention, as has been described above, (1) the resistance plate may be varied in shape, and (2) the power source electrodes and the potential detecting electrodes may be arranged in various configurations on the resistance plate. Thus a waveform of one cycle generated as a result of scanning the potentials at the potential detecting electrodes is stored in the current field on the resistance plate produced by the electrode potential pattern, and such waveform is varied instantly into another waveform by changing the electrode pattern in the waveform generator of the invention.

The invention will be described in more detail by way of concrete examples. In the foregoing embodiments of the invention, the current supplied to the power source electrodes is constant. Instead, this current may be varied to vary the voltage distribution along the potential detecting curve. By continually varying the power supply current, the waveform generated can be continually varied. In an embodiment shown in FIG. 13, an auxiliary electrode 13 is provided in addition to power source electrodes 12, and a continually varying current is supplied to the auxiliary electrode 13. The current field produced by the pattern of the power source electrodes is continually varied by the current supplied to the auxiliary electrode 13, causing the waveform appearing along the potential detecting electrodes to be continually varied.

When the electrode pattern is as shown in FIG. 13, the waveform generated is sinusoidal as shown in FIG. 5 if no auxiliary electrode is used. With the auxiliary electrode 13 provided, harmonics of higher orders can be produced according to the current supplied to the auxiliary electrode 13. This waveform varying function depends more or less upon the number of auxiliary electrodes, the positions at which the auxiliary electrodes are located, and the waveform of current supplied to the auxiliary electrodes. At power source unit 30 which supplies current to the power source electrodes 12, the voltage may be varied whereby the voltage level of the waveform obtained by scanning the potentials at the potential detecting electrodes can be varied although the voltage waveform itself cannot be varied. This means that the waveform can be amplitude-modulated. Assume the power source voltage is of sine wave as shown in FIG. 14A. Then a waveform shown in FIG. 15 can be generated, the waveform being one derived from the cyclic waveform produced by scanning potentials at the potential detecting electrodes and modulated by the power source voltage sine wave. This waveform offers a tremolo effect on musical sound.

When the power source voltage is attenuated in a waveform shown in FIG. 14B, an attenuating vibration waveform analogous to a musical sound waveform produced with a percussion string instrument or a string instrument can be created.

The power source unit used for the purpose of the invention will be described below. FIG. 16A schematically illustrates a circuit diagram of the power source unit embodying the invention, and FIG. 16B shows the logic diagram in the circuit of FIG. 16A. In FIG. 16A, the reference $Tr_1$ denotes a PNP transistor, and $Tr_2$ an NPN transistor, which are similar in characteristic to each other or preferably of complementary characteristic. The transistor $Tr_1$ has its emitter connected to a positive power source $S_1(V)$, its base connected to a digital signal $IN_1$ (positive logic in this example), e.g., an output of TTL, and its collector connected to a collector current limiting resistor R. The other end of the resistor R is used as an output port. The transistor $Tr_2$ has its emitter connected to a power source $S_2(V)$ whose voltage is slightly higher than zero potential, its base connected to a digital signal $IN_2$ similar to $IN_1$, and its collector connected to a resistor R whose resistance is the same as the one connected to the collector of transistor $Tr_1$. The other end of this resistor is used as an output port. The power source voltage $S_1$ is slightly lower than the minimum voltage of the digital voltage at high level, and the power source voltage $S_2$ is slightly higher than the maximum voltage of the digital voltage at low level. In this circuit, the potential at the output port OUT assumes values as shown in FIG. 16B corresponding to four levels of digital voltages $IN_1$ and $IN_2$. This circuit is provided in numbers the same as the number of the power source electrodes 12 installed at all the lattice intersections of lattice pattern 15 shown in FIG. 2, and the output ports of the individual circuits are connected to the power source electrodes 12 respectively. Thus one of the conditions (1) the voltage $S_1$ is applied to the power source electrodes, (2) the voltage $(S_1+S_2)/2$ is applied thereto, (3) no voltage is applied thereto, and (4) the voltage $S_2$ is applied thereto, can be selected according to logic levels assumed by the two inputs $IN_1$ and $IN_2$. Accordingly, an electrode pattern of four logic levels can be formed by the circuit of the invention. That is, the electrode pattern can be modified by rewriting binary logic data.

The power source electrode pattern is modified by the use of the above circuit in the following manner. Assume the number of power source electrodes used is N. Referring to FIG. 17, there is schematically shown a circuit arrangement comprising driver circuits 31 functionally the same as the circuit mechanism shown in FIG. 16A. The circuit 31 has two logic data inputs. In this embodiment, the inputs of 2·N numbers of driver circuits 31 are connected to registers 32 of $2\times N$ bits. These registers are connected to a memory 33. Data in the memory 33 is written in sequence in the registers 32 by a control circuit 36, and the logic data in the registers 32 go directly to the inputs of the driver circuits 31, thereby determining or modifying the power source electrode pattern.

In this example, the capacity of the memory 33 determines the kind of power source electrode pattern, i.e., the number of one-cycle waveforms. Therefore the use of a $2\times N\times M$ bit memory will make M kinds of waveforms available. As a result, the waveform generator of the invention can be constructed to be much simpler than the prior art one which must depend on a D/A converter. For example, according to the invention, the use of 50 power source electrodes makes $4^{50}$ kinds of waveforms available, which are sufficient to produce a wide variety of musical sound waveforms.

In this embodiment, when the register 32 has 100-bit capacity and the memory has 1000-bit capacity, 10 kinds of waveforms can be obtained. Whereas, in the prior art method, one cyclic waveform is produced in such manner that one cycle period is divided into 100 equal intervals and a digital data of 8 to 12 bits is assigned to each point of division. In other words, the prior art method requires a memory of 800 to 1200 bits to store data on one cyclic waveform, as opposed to the method of the invention in which the capacity of the memory to store one cyclic waveform is about one-tenth of that needed in the prior art method. Therefore, with a memory of minimum capacity, the waveform generator of the invention can generate instantaneously varying waveforms to simulate musical sound of a musical instrument.

Another embodiment of the invention is schematically illustrated in FIG. 18, comprising registers 32, a program memory 35, a data memory 34, and a central processor 33. Data in the registers 32 is processed by the data memory 34 and the central processor 33 according to a program stored in the program memory 35. The program is to process parameter data for the property of the sound stored in the memory 35 by the logic depending upon the waveform ratio characteristic of the sounds for composition. The result is output as data for transmitting it to the register 32. This embodiment is useful for applications where the waveform varies under a certain regular rule and at a relatively low speed. As compared with the embodiment in FIG. 17, the arrangement in FIG. 18 needs no memory 33 as in FIG. 17.

The scanning circuit mechanism of the invention will be described in detail. FIG. 19 schematically shows a fundamental circuit of scanning circuit mechanism comprising a switching mechanism 21 having on-off switches provided as many as the number of potential detecting electrodes 20. Further comprising are a scanning control mechanism 24 for sequentially selecting the on-off switches, and a filter circuit 23 for removing noise attending on switching.

Figure 20:
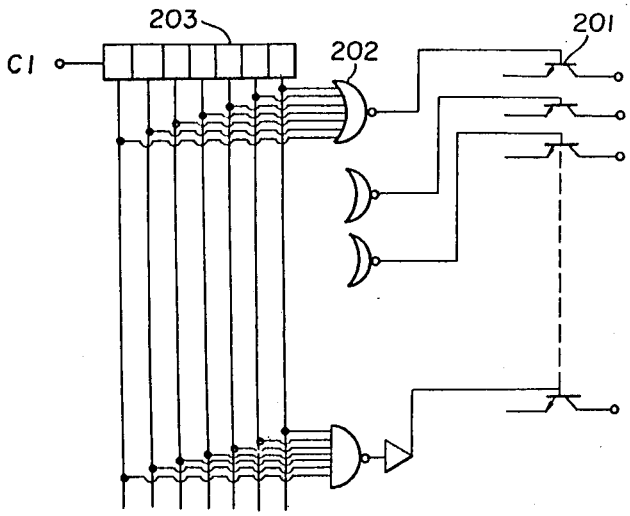
FIG. 20 is a circuit diagram showing a scanning circuit mechanism used in a waveform generator of the invention.

FIG. 20 schematically shows another embodiment of the invention in connection with the embodiment shown in FIG. 19, in which a transistor 201 is used as the switching element, and a binary counter 203 and a gate element 202 are used to constitute the scanning control mechanism. The gate 202 generates a pluse corresponding to a state assumed by the binary counter 203, thereby turning on the transistor 201 which corresponds to the gate. A group of transistors 201 are thus turned on in sequence at regular time intervals whereby the scanning function is performed. This embodiment is useful for an electrode distribution pattern in which the potential detecting electrodes offer potentials causing current of one direction to flow in the transistors 201. Furthermore, this embodiment is advantageous in that the cost of the switching element is low.

Figure 21:
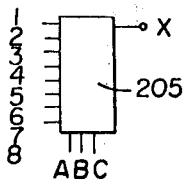
FIG. 21 is a function table showing another scanning circuit mechanism and its IC elements according to the invention.
Figure 22:
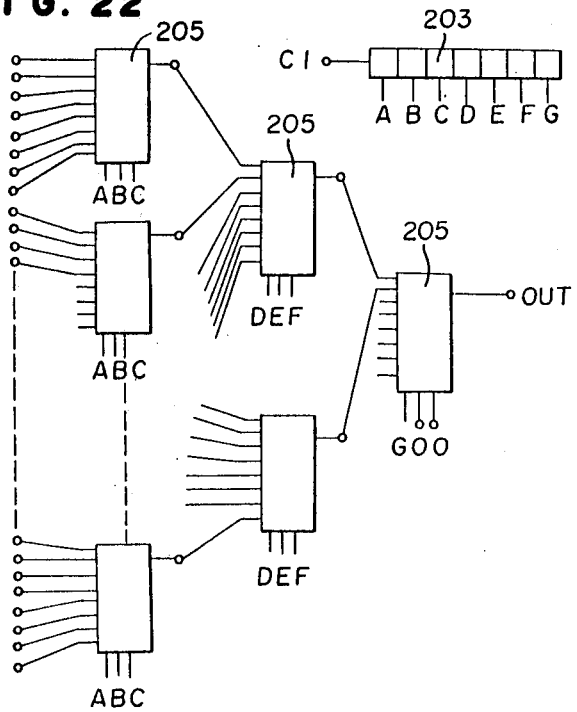
FIG. 22 is a diagram showing scanning circuit mechanism using IC elements shown in FIG. 21.

FIGS. 21 and 22 schematically illustrate another scanning circuit mechanism; FIG. 21 shows an IC element 205 and its logic table. The IC element 205 has 8 analog inputs 1 to 8, one analog output X and three control inputs A, B and C. The IC element is capable of selecting one of 8 analog input signals corresponding to 8 logic states determined by the control input and generating an output at the analog output point X. This IC may be known type such as C-MOSIC.

FIG. 22 schematically illustrates a scanning circuit which uses an IC having the functions as in FIG. 21. This embodiment uses 128 potential detecting electrodes connected to analog input points of 16 IC's 205. The analog output points of these IC's are connected to analog input points of two IC's 205, of which the analog output points are connected to first and second input points of another IC 205. Outputs A, B, C, . . . , G from the individual stages of the binary counter driven by a clock pulse Cl are applied to control input points A, B, C, . . . , G of the IC's 205. By this operation, the potentials at the 128 electrodes are switched one another at every period of the clock pulse and delivered sequentially at the analog output point OUT of the IC of the last stage. According to the invention, therefore, the scanning circuit mechanism can be simplified by the use of IC's shown in FIG. 21.

The period of a waveform generated by scanning potentials at the potential detecting electrodes by the use of the scanning mechanism described above is expanded to a value larger than the period of the clock pulse driving the binary counter 203 by a factor of the number of the electrodes used.

A method used for the waveform generator of the invention for obtaining a frequency-modulated waveform equivalent to pitch vibato in musical sound will be described below. In the waveform generator of the invention, the frequency of a waveform generated depends on the frequency of a clock used to drive the scanning circuit mechanism and on the number of potential detecting electrodes. A method is known in which the clock signal is frequency-modulated in order to frequency-modulate the waveform. According to this method, the clock signal must be provided in numbers equal to the number of waveform generators when a number of waveform generators are operated concurrently and the waveforms generated are frequency-modulated separately. Further, the frequency of the clock signal must be varied over a wide range. To this effect, clock signals of various frequencies are generated by one oscillator through frequency division. The prior art modulation circuit for frequency-modulating such clock signals is very intricate in construction because the modulated frequency widely varies. Whereas the frequency modulation system of the invention operates free of the foregoing prior art drawbacks, being relatively simple in construction and stable in the modulation ratio depending on the clock frequency. The frequency modulation system will be described in more detail.

Referring to FIG. 23, there is shown a circuit diagram of a fundamental circuit according to the frequency modulation system of the invention. FIG. 24 is a diagram showing operations of the circuit shown in FIG. 23. In FIG. 23, the numeral 250 denotes a binary counter, 251 an AND gate, 252 and 254 NAND gates, and 253 an inverter element. In FIG. 24, the reference Cli denotes a clock signal of modulated frequency on which the fundamental frequency of a waveform generated depends. This clock signal is of square waveform with a duty ratio of about 50%. The reference Vi indicates a modulating signal having high (H) and low (L) levels, and Clo a modulated clock signal. In this logic circuit, when the signal Vi is at L level, the output $ST_1$ of the NAND gate 252 takes on H level and the output Clo of the NAND gate stands at the same level as the input clock signal Cli irrespective of the output of the AND gate 251.

When the signal Vi takes on H level, the output $ST_1$ of the NAND gate 252 takes on L level only when the output of the AND gate 251 goes to H level, causing the output Clo of the NAND gate 254 to turn into H level irrespective of the level of the signal $ST_2$ which is the inverted input clock signal. The output of the AND gate 251 takes on H level against one of 8 states which the 3-bit binary counter 250 offers. FIG. 24 shows signal waveforms used for the above operations in which the signal $ST_1$ takes on L level at the eighth cycle of signal Cli. The NAND output Clo derived from the signal $ST_1$ and the signal $ST_2$ which is the inverted signal Cli remains at H level as the result that the L level of the eighth cycle of the signal CLi turns into H level to cause its seventh cycle to be held at H level. In other words, this NAND output assumes a waveform consisting of two pulses in row or has one pulse reduced for 8 pulses of the signal Cli. By using this clock signal Clo to drive the scanning circuit mechanism, the time taken for the scanning circuit mechanism to scan potentials along the full potential detecting curve is elongated in the ratio of 8:7. This indicates the fact that the frequency of the waveform is modulated in the ratio of 7:8. Accordingly, when the above fundamental circuit is used to vary the signal Vi with time as shown in FIG. 25, the frequency of the waveform repeats two states, $f_o$ and $(8/7)f_o$, according to the level of the signal Vi.

In this modulation system, as described, the waveform frequency modulation ratio does not depend on the frequency of the input clock signal Cli. The frequency modulation ratio can be changed by changing the decrement in the number of a series of pulses of the input clock signal. In the fundamental circuit shown in FIG. 23, the frequency modulation ratio can be changed by changing the number of times the output $ST_0$ of the AND gate 251 takes on H level. For example, when the binary counter 250 has a capacity of 4 bits and the AND gate 251 has 4 inputs, the signal $ST_0$ takes on H level to cause the 16th input clock pulse to be level with the 15th pulse where the decrement in the number of pulses is 15:16 and thus the fundamental frequency of the waveform is reduced in the ratio of 15:16. The decrement in the number of pulses can be changed by suitably determining the function of the binary counter 250 and the AND gate 251 (and other gates, if necessary).

This frequency modulation circuit can be effectively utilized, for example, to create vibrato for musical sound in the following manner. This embodiment uses 128 potential detecting electrodes and three functional elements as shown in FIG. 26 associating the concept of the fundamental circuit shown in FIG. 23. In FIG. 26, functions are tabulated indicating that an input clock pulse corresponding to the number indicated in the right box links with a pulse corresponding to the number immediately before the initial one and thereby vanishes when the modulating signal $V_1$ is set to H level. The table in FIG. 26 signifies functions of a frequency modulation circuit in which the decrement in the number of pulses is in the ratio of 63:64, 31:32 and 15:16, that is, the decrement in frequency is in the ratio of 63:64, 31:32 and 15:16. An example of this circuit is schematically shown in FIG. 27, in which the three AND gate outputs $ST_{0-1}$, $ST_{0-2}$ and $ST_{0-3}$ take on H level at each arrival of 64th, 32nd and 16th input clock pulse, and the three NAND gate outputs $ST_{1-1}$, $ST_{1-2}$ and $ST_{1-3}$ take on L level only when the signals $V_1$, $V_2$ and $V_3$ are set to H level. Therefore the output signal Clo of NAND gate 254 assumes a pulse waveform whose width is expanded by a factor of 3 at each arrival of 64th, 32nd and 16th input clock pulse according to the modulating signals $V_1$, $V_2$ and $V_3$. The resultant output signal Clo is used to drive the scanning circuit, which in turn scans potentials along the potential detecting curve to produce a waveform. The frequency of this waveform varies according to the modulating signals $V_1$, $V_2$ and $V_3$. For example, assume the modulating signals $V_1$, $V_2$ and $V_3$ are of pulses occuring at timings shown in FIG. 28A. Then the frequency of the waveform can be varied with time as shown in FIG. 28B. In this example, the frequency is varied in the ratio of 16:17, with a varying period equal to the period of the modulating signal. When the period of the modulating signal is chosen to be 0.1 to 0.3 second, a musical sound waveform accompanying vibrato effect can be produced. A frequency-modulated waveform generated according to the embodiment as in FIG. 26 varies in steps. This waveform can be smoothed by the use of a number of fundamental frequency-modulation circuits differing in the ratio of decrement in the number of pulses.

Briefly, the frequency modulation system of the invention is essentially characterized in that the clock signal used to drive the scanning mechanism which scans potentials at the potential detecting electrodes is of square-wave pulse, and the time for the scanning mechanism to scan all the potentials is varied by partially varying the width of the clock pulse. In the embodiment shown in FIG. 23 the clock pulse width is partially expanded by a factor of 3. Instead, the clock pulse width may be reduced to the same effect. In this case the frequency of the waveform increases by the modulating signal.

Figure 29A:
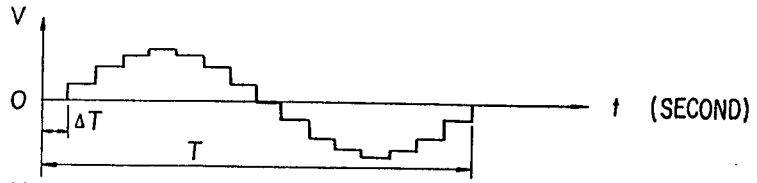
Figure 29B:
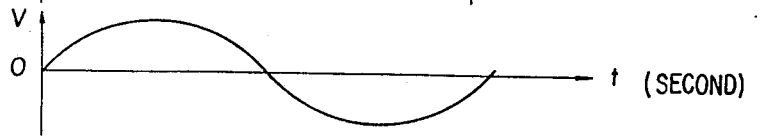
Figure 29C:
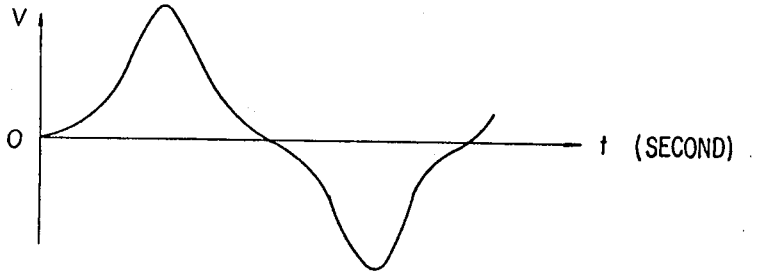
Figure 30A:
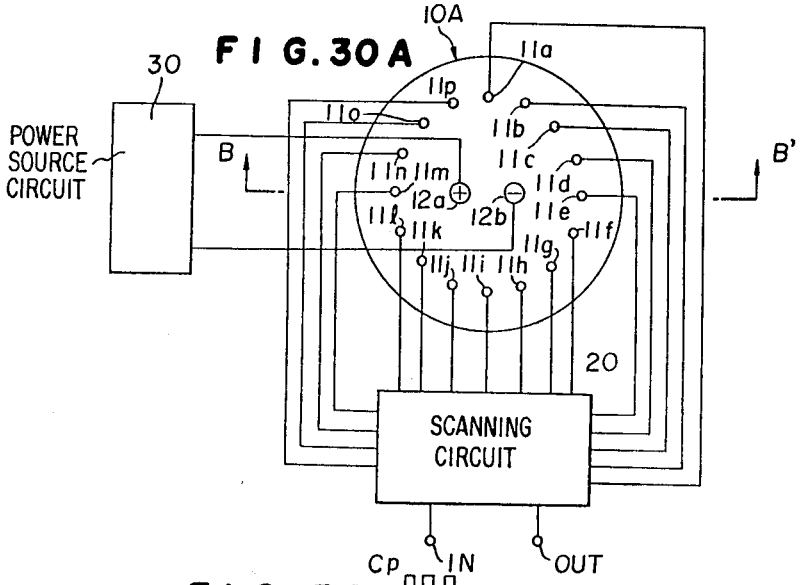
Figure 30B:
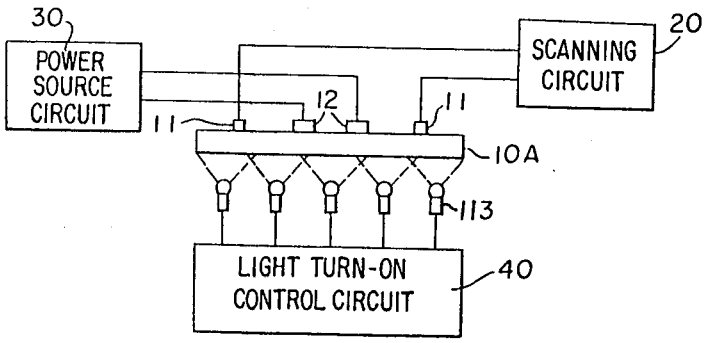
Figure 31A:
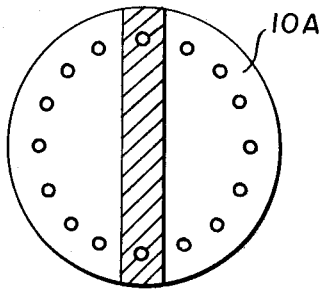
FIG. 31 is a diagram useful for illustrating operations in relation to the circuit shown in FIG. 30, FIGS. 32A and 32B are diagrams showing another waveform generator according to the invention.
Figure 31B:
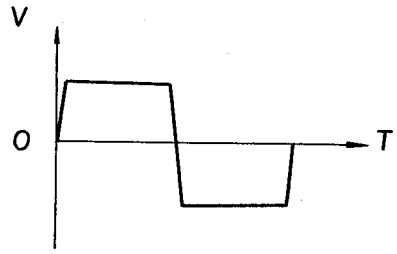

Another embodiment of the invention will be described in reference to the embodiment shown in FIG. 1. In FIG. 1, the output voltage available at the output terminal OUT of the scanning circuit 20 has a correlation to a resistance dependent on the distance between the first electrode 12 and a plurality of second electrodes 11. When the second electrodes 11 are disposed in a circle, the output voltage assumes a quantized sine wave, i.e., a voltage waveform resulting from converting a sine wave into a waveform pulsed at regular intervals as shown in FIG. 29A. When the number of second electrodes is increased, the output voltage of the scanning circuit 20 assumes a waveform having smoothed steps or an approximately sinusoidal waveform as shown in FIG. 29B. When the second electrodes 11 are disposed in a circle and the first electrodes 12 are disposed away from the center of the resistance disk, the output voltage of the scanning circuit 20 assumes a waveform shown in FIG. 29C. For example, to generate a continuous signal of which one waveform extends over one cycle (T second), the scanning circuit 20 is driven by a clock pulse cp whose width $\Delta T$ is (T/N) (sec) where N is the number of the second electrodes. Accordingly, the waveform generated can be varied by varying the positions of first electrodes 12 and second electrodes 11 or the number of these electrodes or the shape of the resistance plate 10. With this approach, however, it is impossible to obtain a wide variety of waveforms because the positions of the electrodes and the shape of the resistance plate can hardly be altered once these elements are fabricated into a regular form. Whereas, according to the invention, these difficulties are overcome by providing a waveform generator capable of generating a wide variety of waveforms by changing resistance values or resistance distribution pattern on the resistance plate. FIG. 30A and 30B schematically illustrate a waveform generator embodying the invention; FIG. 30A is a plan view of a resistance plate 10A, and FIG. 30B is a cross-sectional view taken across B–B′ in FIG. 30A. The resistance plate 10A is made of a material such as CdS whose resistivity varies with the value of light applied. When the resistance plate is of CdS, the resistance of the area exposed to light is reduced. Power supply electrodes 12 (or first electrodes 12*a* and 12*b* in this example) receiving power source voltage and a plurality of potential detecting electrodes 11 (or second electrodes 11*a* to 11*p* in this example) are installed on the photosensitive resistance plate 10A. Voltage (or current) is supplied to the first electrodes 12 from a power source circuit 30. The second electrodes 11*a* to 11*p* are connected to a scanning circuit 20. A plurality of light-emitting elements 113 such as electric bulbs or light-emitting diodes are disposed opposite the back of the photosensitive resistance plate 10A. A light turn-on control circuit 40 is provided for controlling turn-on of the light-emitting elements 113. FIGS. 31A and 31B schematically illustrate operations of the circuit as in FIGS. 30A and 30B; FIG. 31A shows the resistance plate 10A partly exposed to light from the light-emitting elements 113, and FIG. 31B shows an output waveform generated by the waveform generator in relation to operation as in FIG. 31A. The operation of this waveform generator will be described by referring to FIGS. 29A to 31B. A voltage is applied to the first electrodes 12 from the power source circuit 30. The scanning circuit 20 scans in time sequence the second electrodes 11*a* to 11*p* according to the input clock pulse cp and detects potentials at the second electrodes 11*a* to 11*p* in correlation with a resistance dependent on the distance between the first electrodes 12 and the second electrodes 11*a* to 11*p*. The light turn-on control circuit 40 controls turn-on of the light-emitting elements 113, causing the light to be applied to the photosensitive resistance plate 10A or no light to be applied thereto. With no light applied, the output of the scanning circuit assumes a waveform shown in FIG. 29A. When the light is applied thereto in the area other than the hatched area, the resistance in the non-hatched area becomes smaller than that in the hatched area. As a result, the output generated at the output terminal OUT of the scanning circuit 20 assumes an approximately square waveform shown in FIG. 31B. Thus, by controlling turn-on of the light-emitting elements 113 to cause light to be applied to the desired area on the resistance plate 10A, the resistance distribution on the resistance plate can be varied. On this principle, the waveform generator of the invention can generate a wide variety of waveforms.

Figure 32A:
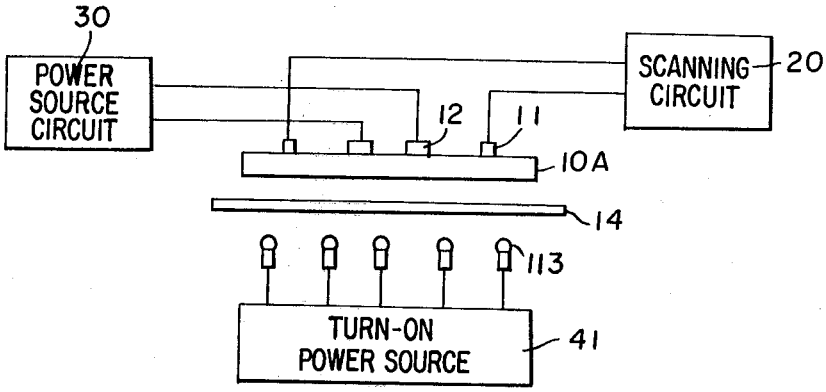
Figure 32B:
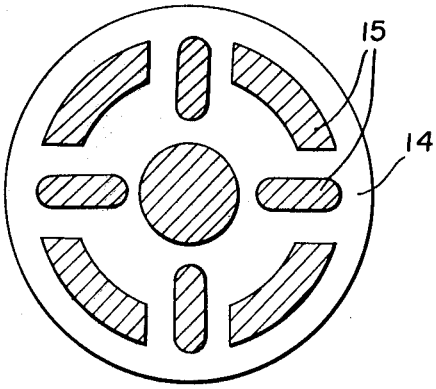

FIG. 32A schematically illustrates another waveform generator of the invention, and FIG. 32B is a plan view of a mask member 14 used for the waveform generator shown in FIG. 32A. The mask member 14 is located between the photosensitive resistance plate 10A (FIG. 30A) and the light-emitting elements 113 (FIG. 30A). There is provided a turn-on power source 41, in place of the light turn-on control circuit 40, for the light-emitting elements 113. Like constituent components are indicated by the identical references in FIGS. 30A, 30B and 32A. The mask member 14 has regions 15 which intercept light. The shape of the region 15 depends on the pattern of light applied. The resistance distribution pattern on the photosensitive resistance plate 10A can be varied by varying the shape of the shield region 15. According to this embodiment, the circuit construction can be simplified because the waveform generated can be varied by varying the shape of the shield region 15 with all the light-emitting elements 113 held lighted by the light power source 41.

Figure 33A:
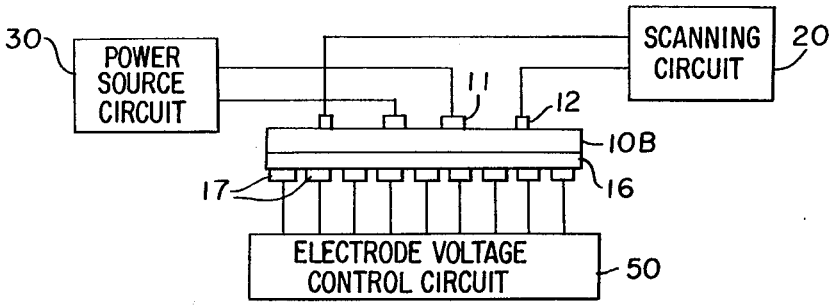
FIGS. 33A and 33B are diagrams showing another waveform generator according to the invention.
Figure 33B:
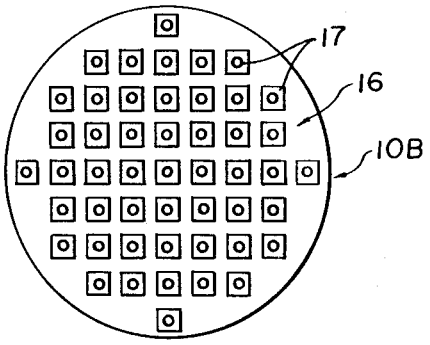

FIG. 33A is a schematic diagram showing another waveform generator of the invention, and FIG. 33B is a plan view of the back of a plate member used for the embodiment as in FIG. 33A. According to this embodiment, the resistance distribution on the resistance plate is varied under voltage control, not by varying light value as in the embodiment shown in FIG. 30B. The plate member 10B is made of a semiconductor such as silicon crystal doped with an impurity, and first and second electrodes 12 and 11 are formed on the semiconductor plate 10B. An insulating layer 16 is formed on the back of the semiconductor plate 10B. On the insulating layer 16 are a plurality of resistance varying electrodes 17 disposed at regular intervals. These electrodes 17 are isolated from each other and supplied with voltage from an electrode voltage control circuit 50. A voltage is applied to the first electrodes 12 from the power source circuit 30. The scanning circuit 20 scans in time sequence the potentials at the second electrodes 11. Concurrently, the electrode voltage control circuit 50 applies a voltage to one of the resistance varying electrodes 17. The resistance of the semiconductor plate 10B in the area near the electrode 17 to which the voltage is applied decreases with increase in the voltage applied or increases with decrease in the voltage applied when the impurity added to the semiconductor is n type. While, when the impurity thereof is p type, the above resistance behavior is reversed. Hence the resistance distribution pattern on the semiconductor plate 10B, i.e., the potentials scanned out of the second electrodes 11 by the scanning circuit 20, can be varied by varying the voltage applied to the resistance varying electrode 17 through the electrode voltage control circuit 50 for varying the position of the resistance varying electrode 17 to which the voltage is applied. This enables the waveform generator of the invention to generate a wide variety of waveforms. Furthermore, in this embodiment, not only the position of the resistance varying electrode to which the voltage is applied, but also the voltage applied thereto can be controlled and, as a result, more kinds of waveforms can be obtained than by controlling the positions of light-emitting elements to be turned on.

As has been described hereinbefore, the waveform generator of the invention can generate a wide variety of waveforms by varying the resistance value or resistance distribution pattern on the resistance plate. Waveforms available with this device are useful particularly in creating or simulating musical sound of various musical instruments.

While preferred embodiments of the invention and specific modifications thereof have been described, it is to be understood that numerous variations may occur to those skilled in the art without departing from the spirit of the invention.

What is claimed as new and desired to be secured by Letters Patent of the United States is:

1. A waveform generator comprising:

a resistance plate;

a plurality of power source electrodes disposed on the resistance plate;

a plurality of potential detecting electrodes disposed on the resistance plate;

power source means for supplying a steady current to the power source electrodes to produce a potential distribution on the resistance plate; and scanning circuit means connected to the potential detecting electrodes for periodically scanning potentials at the potential detecting electrodes to generate a voltage waveform.

2. The waveform generator according to claim 1 comprising an auxiliary electrode disposed at a given position on said resistance element, wherein a current whose value is continually varying is applied to said auxiliary electrode.

3. The waveform generator according to claim 1 wherein a current whose value is continually varying is superposed on the current supplied to said power source electrodes and thereby a tremolo effect, an attenuating vibration effect is produced.

4. The waveform generator according to claim 1 wherein the power source means includes: a PNP transistor with its emitter connected to a dc power source whose voltage is slightly lower than the minimum voltage of a logic signal at a high level; an NPN transistor with its emitter connected to a dc power source whose voltage is slightly higher than the maximum voltage of a logic signal at a low level; wherein the collectors of the two transistors are connected to each other through a resistor, the center of the resistor is connected to at least one power source electrode and the logic signal is applied to the bases of the two transistors, thus causing the one power source electrode to have one of three kinds of voltage level and one constant level corresponding to four states assumed by the logic signal.

5. The waveform generator according to claim 1 comprising: driver circuits equal in number to said power source electrodes; means for supplying a logic signal to said driver circuits, said driver circuits capable of generating an output whose voltage takes on a value corresponding to the value of the logic signal; registers for storing all the logic signals supplied to said driver circuits; a memory device for storing plural kinds of data from said registers; and a control device capable of temporarily transferring data from said memory device to the registers; wherein data in said memory device is transferred to the registers by said control device, and the pattern of the output voltage level of said driver circuit is varied and thus the waveform is varied.

6. The waveform generator according to claim 1 comprising: driver circuits equal in number to said power source electrodes; means for supplying a logic signal to said driver circuits, said driver circuits capable of generating an output whose voltage takes on a value corresponding to the value of the logic signal; registers for storing all the logic signals supplied to said driver circuits; and a computing control device for processing and modifying data in said registers according to a program; wherein data in said registers are replaced according to the program of said computing control device, thereby causing the pattern of the output voltage level of the driver circuit and thus the waveform is modified.

7. The waveform generator according to claim 1 wherein said scanning circuit means is driven by a square wave clock pulse, the width of the clock pulse corresponds to the time taken to scan one potential detecting electrode, and several clock pulses selected are varied in width to cause the waveform to be frequency-modulated.

8. The waveform generator according to claim 1 wherein the resistance element includes a plate member having a resistance component whose distribution can be varied; and including resistance distribution varying means for varying the distribution of said resistance component.

9. The waveform generator according to claim 8, wherein said plate member is a photosensitive resistance plate, and said resistance distribution varying means is a light-emitting means.

10. The waveform generator according to claim 8, wherein said plate member is a member whose state of resistance distribution is varied by an applied voltage and has resistance varying electrodes, and said resistance distribution varying means is a means for controlling the voltage applied to said resistance varying electrodes.

11. A waveform generator comprising:

a resistance element;

a plurality of power source electrodes disposed on the resistance element;

a plurality of potential detecting electrodes disposed on the resistance element;

power source means for supplying a current to the power source electrodes to produce a potential distribution on the resistance element;

a circuit mechanism for controlling in sequence values of the current supplied to said power source electrodes; and scanning circuit means connected to the potential detecting electrodes for periodically scanning potentials at the potential detecting electrodes to generate a voltage waveform, wherein the frequency spectrum of the voltage waveform obtained by periodically scanning potentials at said potential detecting electrodes is varied in sequence.

* * * * *